US011386761B2

(12) United States Patent
Bergman et al.

(10) Patent No.: US 11,386,761 B2
(45) Date of Patent: Jul. 12, 2022

(54) METHODS AND APPARATUSES FOR DETECTING AN UNAUTHORIZED RF DEVICE

(71) Applicant: Sensormatic Electronics, LLC, Boca Raton, FL (US)

(72) Inventors: Adam S. Bergman, Boca Raton, FL (US); Steve Trivelpiece, Rancho San Margarita, CA (US); David Torrecilla, Madrid (ES)

(73) Assignee: SENSORMATIC ELECTRONICS, LLC, Boca Raton, FL (US)

( * ) Notice: Subject to any disclaimer, the term of this patent is extended or adjusted under 35 U.S.C. 154(b) by 0 days.

(21) Appl. No.: 17/014,837

(22) Filed: Sep. 8, 2020

(65) Prior Publication Data

US 2022/0076550 A1 Mar. 10, 2022

(51) Int. Cl.
*G08B 13/24* (2006.01)

(52) U.S. Cl.
CPC ..... *G08B 13/2417* (2013.01); *G08B 13/2471* (2013.01)

(58) Field of Classification Search
CPC ..... H04B 1/109; H04K 3/224; H04K 3/822; G07F 19/2055; G06K 7/10267; G06K 7/0008
See application file for complete search history.

(56) References Cited

U.S. PATENT DOCUMENTS 6,609,656 B1 8/2003 Elledge
2006/0273902 A1 12/2006 Shafer et al.
2007/0232219 A1* 10/2007 Xiong ..... H04K 3/224 455/1
2010/0148964 A1* 6/2010 Broer ..... G06K 7/0008 340/572.1
2010/0289627 A1* 11/2010 McAllister ..... G06F 21/44 340/10.42
2013/0106577 A1* 5/2013 Hinman ..... G06K 7/10267 340/10.1
2015/0213427 A1* 7/2015 Hodges ..... G07F 19/2055 705/18

FOREIGN PATENT DOCUMENTS

EP 3296916 A1 3/2018

OTHER PUBLICATIONS

International Search Report and Written Opinion issued in corresponding International Application No. PCT/US2021/071371 dated Jan. 4, 2022.

* cited by examiner

*Primary Examiner* — Mirza F Alam
(74) *Attorney, Agent, or Firm* — ArentFox Schiff LLP

(57) ABSTRACT

Aspects of the present disclosure include methods, systems, and non-transitory computer readable media for identifying one or more authorized signal characteristic associated with at least one authorized RF signal, receiving at least one incoming RF signal having one or more incoming signal characteristic, identifying the one or more incoming signal characteristic, determining a presence of the unauthorized RF device based on at least one of the one or more authorized signal characteristic or the one or more incoming signal characteristic, and activating an alarm in response to determining the presence of the unauthorized RF device.

27 Claims, 4 Drawing Sheets

METHODS AND APPARATUSES FOR DETECTING AN UNAUTHORIZED RF DEVICE

BACKGROUND

In an retail environment, lost, stolen, or misplaced merchandises may result in loss revenue for the retail store. As a counter measure, the retail store may place security tags on merchandises to prevent loss. The retail store may use one or more authorized radio frequency (RF) scanners to locate the security tags in order to track the merchandises. If a potential shoplifter attempts to remove a merchandise from the retail store without purchasing the merchandise, the one or more authorized RF scanners may detect the security tag (associated with the stolen merchandise) leaving the retail store. In response, the one or more authorized RF scanners may trigger a notification or alarm.

However, the potential shoplifter may utilize an authorized RF device to disrupt the operation of the one or more authorized RF scanners. Therefore, improvements in security system may be desirable.

SUMMARY

This summary is provided to introduce a selection of concepts in a simplified form that are further described below in the DETAILED DESCRIPTION. This summary is not intended to identify key features of the claimed subject matter, nor is it intended to be used as an aid in determining the scope of the claimed subject matter.

Aspects of the present disclosure include methods, systems, and non-transitory computer readable media for identifying one or more authorized signal characteristic associated with at least one authorized RF signal, receiving at least one incoming RF signal having one or more incoming signal characteristic, identifying the one or more incoming signal characteristic, determining a presence of the unauthorized RF device based on at least one of the one or more authorized signal characteristic or the one or more incoming signal characteristic, and activating an alarm in response to determining the presence of the unauthorized RF device.

An aspect of the present disclosure includes a method including identifying one or more authorized signal characteristic associated with at least one authorized RF signal, receiving at least one incoming RF signal having one or more incoming signal characteristic, identifying the one or more incoming signal characteristic, determining a presence of the unauthorized RF device based on at least one of the one or more authorized signal characteristic or the one or more incoming signal characteristic, and activating an alarm in response to determining the presence of the unauthorized RF device.

Aspects of the present disclosure includes a radio frequency identification (RFID) scanner including a RFID driver, a memory that stores instructions, and a processor configured to execute the instructions to identify one or more authorized signal characteristic associated with at least one authorized RF signal, cause the RFID driver to receive at least one incoming RF signal having one or more incoming signal characteristic, identify the one or more incoming signal characteristic, determine a presence of the unauthorized RF device based on at least one of the one or more authorized signal characteristic or the one or more incoming signal characteristic, and activate an alarm in response to determining the presence of the unauthorized RF device.

Certain aspects of the present disclosure includes a non-transitory computer readable medium having instructions stored therein that, when executed by a processor, cause the processor to identify one or more authorized signal characteristic associated with at least one authorized RF signal, cause the RFID driver to receive at least one incoming RF signal having one or more incoming signal characteristic, identify the one or more incoming signal characteristic, determine a presence of the unauthorized RF device based on at least one of the one or more authorized signal characteristic or the one or more incoming signal characteristic, and activate an alarm in response to determining the presence of the unauthorized RF device.

BRIEF DESCRIPTION OF THE DRAWINGS

The features believed to be characteristic of aspects of the disclosure are set forth in the appended claims. In the description that follows, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objects and advantages thereof, will be best understood by reference to the following detailed description of illustrative aspects of the disclosure when read in conjunction with the accompanying drawings, wherein:

DETAILED DESCRIPTION

The following includes definitions of selected terms employed herein. The definitions include various examples and/or forms of components that fall within the scope of a term and that may be used for implementation. The examples are not intended to be limiting.

In some aspects of the present disclosure, a radio frequency identification (RFID) scanner may be configured to detect an unauthorized radio frequency (RF) device. For example, a retail store may use the RFID scanner, with RFID security tags attached to merchandises, to track and/or inventory the merchandises. Specifically, the RFID scanner may identify any merchandise being removed by a shoplifter from the retail store without proper payment. To counter this, the shoplifter may deploy an unauthorized RF device to interfere with the operation of the RFID scanner by "jamming" the RFID scanner.

In one aspect of the present disclosure, the RFID scanner may be configured to distinguish RF signals from an authorized device and the RF signals from an unauthorized device. If the RFID scanner detects unauthorized RF signals, the RFID scanner may activate an alarm to alert the security personnel and/or clerks associated with the retail store. For example, the RFID scanner (or another RFID scanner associated with the retail store) may transmit one or more authorized RF signals intended for the RFID security tags associated with the retail store. The shoplifter may deploy the unauthorized RF device to attempt to jam the RFID scanner by transmitting one or more unauthorized RF signals. The RFID scanner may receive the one or more unauthorized RF signals as one or more incoming RF signals. The RFID scanner may compare the characteristics (e.g., frequency, amplitude, time, duration, waveform shape, phase, etc.) of the one or more authorized RF signals with the characteristics of the one or more incoming RF signals. If the characteristics of the one or more authorized RF signals are different than the characteristics of the one or more incoming RF signals, the RF scanner may determine the presence of the unauthorized RF device, and activate an alarm.

Figure 1:
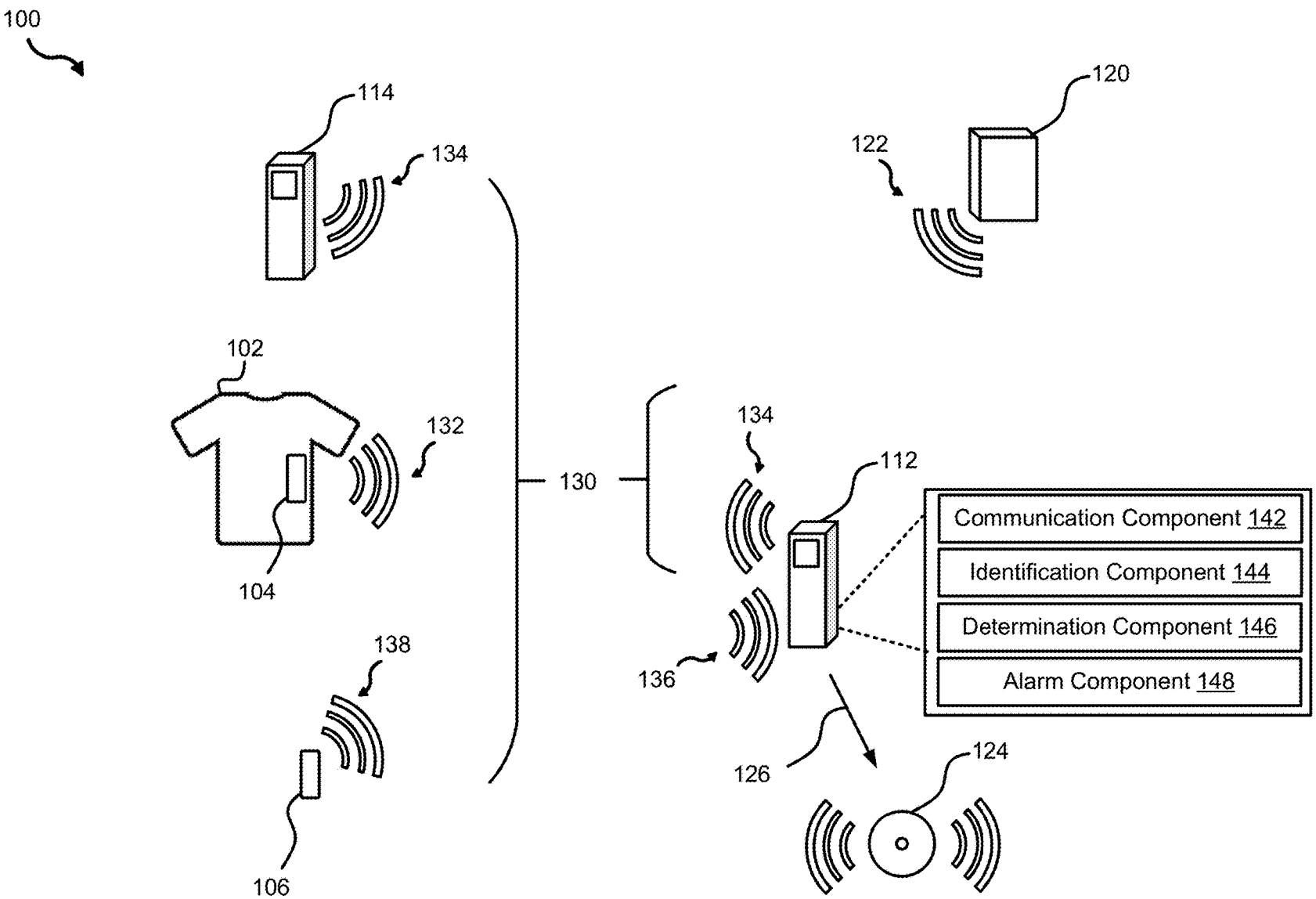
FIG. 1 illustrates an example of an environment for determining the presence of an unauthorized RF device in accordance with aspects of the present disclosure.

FIG. 1 illustrates an example of an environment 100 (e.g., a retail store) for detecting an unauthorized RF device according to aspects of the present disclosure. The environment 100 may include a merchandise 102 having a security tag 104 attached to the merchandise 102. The security tag 104 may be locked (e.g., unable to be removed from the merchandise 102 without damaging the merchandise 102) to the merchandise 102. The security tag 104 may include a RFID device 240 configured to transmit and/or receive RFID signals.

In certain implementations, the environment 100 may include a RFID scanner 112 configured to detect the presence of an unauthorized RF device 120. The RFID scanner 112 may include a communication component 142 configured to transmit and/or receive RF signals. The RFID scanner 112 may include an identification component 144 configured to identify one or more characteristics associated with RF signals. The RFID scanner 112 may include a determination component 146 configured to determine the presence of the unauthorized RF device 120 based on the characteristics of authorized RF signals (e.g., configured to be transmitted by the RFID scanner 112 or by an optional RF transmitter 114) and the characteristics of unauthorized RF signals. The RFID scanner 112 may include an alarm component 148 that activates an alarm when detecting the unauthorized RF device 120.

In some aspects, the environment 100 may optionally include a control RFID tag 106. The control RFID tag 106 may receive RF signals from the RFID scanner 112 (or the optional RF transmitter 114), and transmit a control RF signal in response.

During operation, in certain implementations, the RFID scanner 112 may transmit at least one source RF signal 134. The at least one source RF signal 134 may be intended for the security tag 104. The at least one source RF signal 134 may be transmitted or be scheduled to be transmitted by the RFID scanner 112 and/or the optional RF transmitter 114. In response to receiving the at least one source RF signal 134, the security tag 104 may transmit at least one response RF signal 132 to the RFID scanner 112. The at least one response RF signal 132 may indicate the location of the security tag 104, merchandise information associated with the merchandise 102, etc.

In some instances, a shoplifter (not shown) may utilize the unauthorized RF device 120 to transmit at least one unauthorized RF signal 122 to disrupt the operations of the RFID scanner 112 and/or the security tag 104. For example, the unauthorized RF device 120 may transmit the at least one unauthorized RF signal 122 at a power level significantly higher than the power level of the at least one response RF signal 132. As a result, the at least one unauthorized RF signal 122 may prevent the RFID scanner 112 from properly receiving and/or detecting the at least one response RF signal 132. In another example, the unauthorized RF device 120 may transmit the at least one unauthorized RF signal 122 to prevent the security tag 104 from properly receiving the one or more source RF signals 134. As a result, the security tag 104 may not be able to transmit the at least one response RF signal 132.

In some aspects of the present disclosure, the RFID scanner 112 may identify, via the identification component 144, the one or more authorized signal characteristic of the at least one authorized RF signal 130. The one or more authorized signal characteristic may include the amplitude, the frequency, the power level (average or instantaneous), duty cycle, transmission time, period, on/off duration, wavelengths, and/or other characteristics of the at least one authorized RF signal 130. The at least one authorized RF signal 130 may include portions or all of the at least one source RF signal 134, the at least one response RF signal 132, and/or at least one control RF signal 138 (described below).

In some aspects, the RFID scanner 112 may utilize hardware and/or software to identify the one or more authorized signal characteristic. For example, the RFID scanner 112 may include a frequency counter and/or a resonant circuit (not shown) to determine the frequency of the at least one authorized RF signal 130. In another example, the RFID scanner 112 may include a wattmeter to measure the power level of the at least one authorized RF signal 130.

In certain implementations, the RFID scanner 112 may receive, via the communication component 142, at least one incoming RF signal 136 having one or more incoming signal characteristic. The at least one incoming RF signal 136 may be the at least one unauthorized RF signal 122 or the at least one authorized RF signal 130. The RFID scanner 112 may be unable to distinguish the at least one unauthorized RF signal 122 and the at least one authorized RF signal 130 until identifying the one or more incoming signal characteristic of the at least one incoming RF signal 136.

In an aspect of the present disclosure, the RFID scanner 112 may identify, via the identification component 144, the one or more incoming signal characteristic of the at least one incoming RF signal 136. The one or more incoming signal characteristic may include the amplitude, the frequency, the power level (average or instantaneous), duty cycle, transmission time, period, on/off duration, wavelengths, and/or other characteristics of the at least one incoming RF signal 136.

In some aspect, the RFID scanner 112 may determine, via the determination component 146, a presence of the unauthorized RF device 120 based on at least one of the one or more authorized signal characteristic of the at least one authorized RF signal 130 or the one or more incoming signal characteristic of the at least one incoming RF signal 136 (e.g., the at least one unauthorized RF signal 122). The determination may be performed over a specific duration of time.

For example, the RFID scanner 112 may determine the presence of the unauthorized RF device 120 based on the frequency of the at least one authorized RF signal 130 being different than the frequency of the at least one unauthorized RF signal 122.

In another example, the RFID scanner 112 may determine the presence of the unauthorized RF device 120 based on the frequency and/or power level of the at least one authorized RF signal 130 being within the regulatory limit while the frequency and/or power level of the at least one unauthorized RF signal 122 being beyond the regulatory limit. The at least one unauthorized RF signal 122 may be transmitted at a power level above the regulatory threshold and the at least one authorized RF signal 130 may be transmitted at a power level below the regulatory threshold. The at least one unauthorized RF signal 122 may be transmitted at a frequency beyond the regulatory range and the at least one authorized RF signal 130 may be transmitted at a frequency within the regulatory range.

In other examples, the RFID scanner 112 may determine the presence of the unauthorized RF device 120 based on the transmission time of the at least one authorized RF signal 130 being different than the transmission time of the at least one unauthorized RF signal 122. The at least one authorized RF signal 130 may be transmitted between the time of t=0 to t=50 milliseconds (ms), and t=100 ms to t=150 ms, and may not be transmitted between the time of t=51 ms to t=99 ms. At least a portion of the at least one unauthorized RF signal 122 may be transmitted (by the unauthorized RF device 120) during the time of t=51 ms to t=99 ms. The RFID scanner 112 may determine the presence of the unauthorized RF device 120 based on at least a portion of the at least one unauthorized RF signal 122 being transmitted during the time of t=51 ms to t=99 ms.

In one aspect of the present disclosure, the RFID scanner 112 and/or the optional RF transmitter 114 may transmit the at least one source RF signal 134 to the control RFID tag 106. The control RFID tag 106 may respond with the at least one control RF signal 138 to the RFID scanner 112. If the unauthorized RF device 120 transmits the at least one unauthorized RF signal 122, the control RFID tag 106 may be unable to properly receive the at least one source RF signal 134, and/or transmit the at least one control RF signal 138. The RFID scanner 112 may determine the presence of the unauthorized RF device 120 based on the RFID scanner 112 being unable to detect the at least one control RF signal 138 after transmitting the at least one source RF signal 134.

In some aspects of the present disclosure, the RFID scanner 112 may periodically receive background signals, including one or more of the at least one authorized RF signal 130, and/or signals from other transmitters in the environment 100 (e.g., cellular phones belonging to customers in the retail store). The RFID scanner 112 may determine a background power level associated with the background signals. If the unauthorized RF device 120 transmits the at least one unauthorized RF signal 122, the RFID scanner 112 may receive the at least one unauthorized RF signal 122 as the at least one incoming RF signal 136. The RFID scanner 112 may determine that the power level associated with the at least one incoming RF signal 136 exceeds the background power level. In response, the RFID scanner 112 may determine the presence of the unauthorized RF device 120.

In some aspect, the RFID scanner 112 may activate an alarm 124, via the alarm component 148, in response to determining the presence of the unauthorized RF device 120. In some examples, the RFID scanner 112 may send an alarm signal 126 to an optional alarm system (not shown) in the RFID scanner 112 to activate the alarm system (e.g., audio siren and/or visual light). In another example, the RFID scanner 112 may transmit an indication signal (e.g., the alarm signal 126) to an external alarm system (e.g., the alarm 124) to activate the external alarm system. The alarm system (optional and/or external) may alert personnel associated with the environment 100 (e.g., retail store clerk, security, etc.) regarding the presence of the unauthorized RF device 120.

Figure 2:
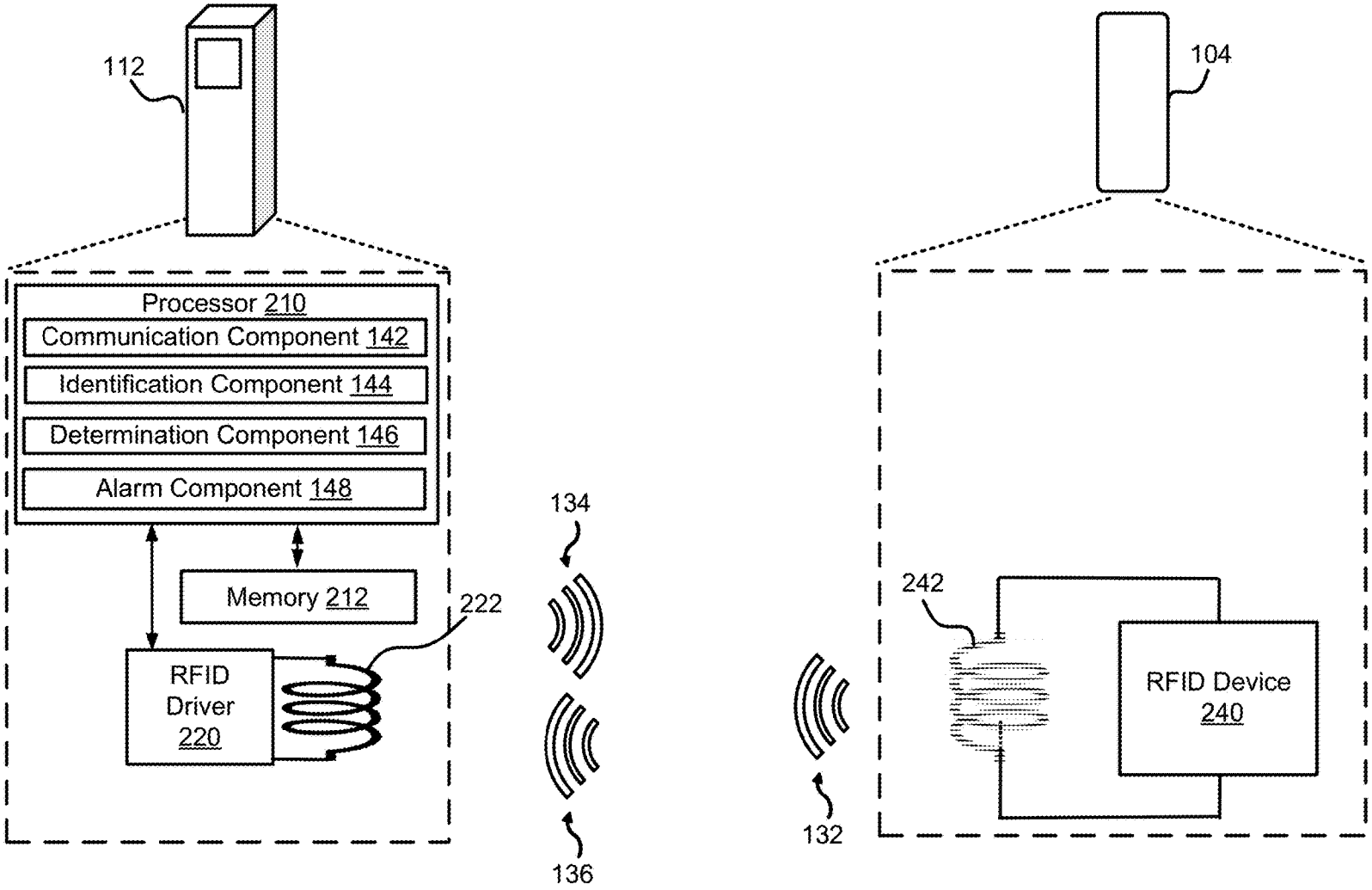
FIG. 2 illustrates an example of a radio frequency identification (RFID) scanner and a security tag in accordance with aspects of the present disclosure.

Referring to FIGS. 1 and 2, an example of the RFID scanner 112 may be configured to transmit the at least one source RF signal 134 and/or receive the at least one incoming RF signal 136. The RFID scanner 112 may include a processor 210 that executes instructions stored in a memory 212 for detecting the unauthorized RF device 120 described herein.

The term "processor," as used herein, can refer to a device that processes signals and performs general computing and arithmetic functions. Signals processed by the processor can include digital signals, data signals, computer instructions, processor instructions, messages, a bit, a bit stream, or other computing that can be received, transmitted and/or detected. A processor, for example, can include microprocessors, microcontrollers, digital signal processors (DSPs), field programmable gate arrays (FPGAs), programmable logic devices (PLDs), state machines, gated logic, discrete hardware circuits, and other suitable hardware configured to perform the various functionality described herein. The term "memory," as used herein, can include volatile memory and/or nonvolatile memory. Non-volatile memory can include, for example, ROM (read only memory), PROM (programmable read only memory), EPROM (erasable PROM) and EEPROM (electrically erasable PROM). Volatile memory can include, for example, RAM (random access memory), synchronous RAM (SRAM), dynamic RAM (DRAM), synchronous DRAM (SDRAM), double data rate SDRAM (DDR SDRAM), and direct RAM bus RAM (DRRAM).

The term "memory," as used herein, can include volatile memory and/or nonvolatile memory. Non-volatile memory can include, for example, ROM (read only memory), PROM (programmable read only memory), EPROM (erasable PROM) and EEPROM (electrically erasable PROM). Volatile memory can include, for example, RAM (random access memory), synchronous RAM (SRAM), dynamic RAM (DRAM), synchronous DRAM (SDRAM), double data rate SDRAM (DDR SDRAM), and direct RAM bus RAM (DRRAM).

In some implementations, the RFID scanner 112 may include the memory 212. The RFID scanner 112 may include a RFID driver 220 configured to transmit and/or receive RF signals via a scanner coil 222. The RFID driver 220 may energize the scanner coil 222 to transmit the RF signals. The scanner coil 222 may include one or more inductors that transmit or receive electromagnetic signals. Additionally, in some non-limiting examples, the security tag 104 may include the RFID device 240 that transmits and/or receives RF signals via a tag coil 242.

During operation, in some implementations, the processor 210, the memory 212, and/or the identification component 144 of the RFID scanner 112 may identify the one or more authorized signal characteristic associated with one or more authorized RF signal. For example, the processor 210, the memory 212, and/or the identification component 144 of the RFID scanner 112 may identify the one or more authorized signal characteristic of the at least one authorized RF signal 130. The at least one authorized RF signal 130 may be transmitted by the RFID scanner 112 the optional RF transmitter 114, the security tag 104, the control RFID tag 106, and/or other authorized RF devices in the environment 100.

In an implementation, the processor 210, the memory 212, and/or the communication component 142 of the RFID scanner 121 may receive the at least one incoming RF signal 136. For example, the processor 210, the memory 212, and/or the communication component 142 of the RFID scanner 112 may receive the at least one incoming RF signal 136. The at least one incoming RF signal 136 may be a portion or all of the at least one unauthorized RF signal 122.

In certain aspects, the processor 210, the memory 212, and/or the identification component 144 of the RFID scanner 112 may identify the one or more incoming signal characteristic of the at least one incoming RF signal 136. For example, the processor 210, the memory 212, and/or the identification component 144 of the RFID scanner 112 may identify the amplitude, the frequency, the power level (average or instantaneous), duty cycle, transmission time, period, on/off duration, wavelengths, and/or other characteristics of the at least one incoming RF signal 136.

In some aspects of the present disclosure, the memory 212, and/or the determination component 146 of the RFID scanner 112 may determine a presence of the unauthorized RF device 120 based on at least one of the one or more authorized signal characteristic and/or the one or more incoming signal characteristic as described above.

In one aspect of the present disclosure, the processor 210, the memory 212, and/or the alarm component 148 may activate an alarm system in response to determining the presence of the unauthorized RF device 120 as described above.

Figure 3:
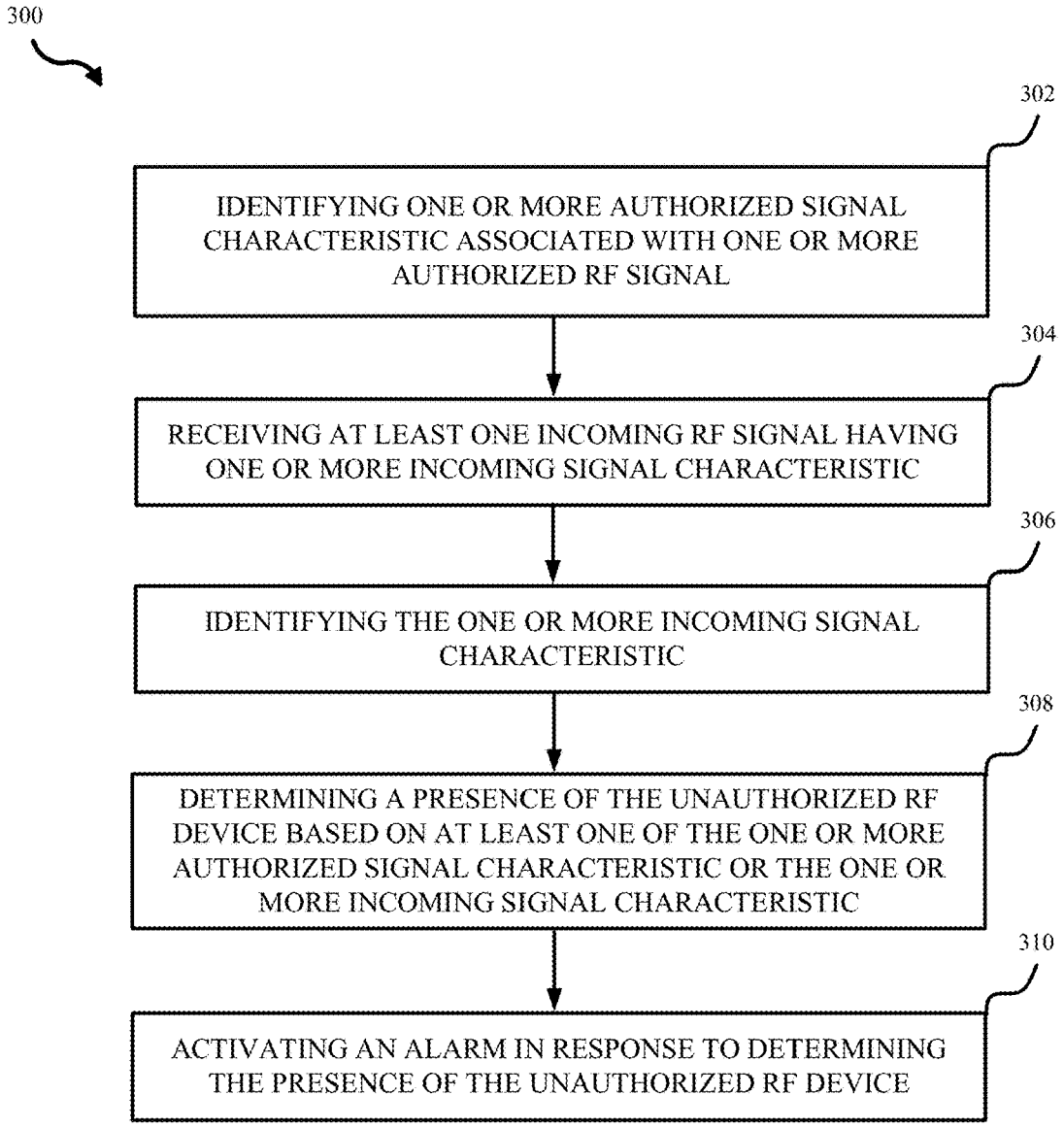
FIG. 3 illustrates an example of a method for determining the presence of an unauthorized RF device in accordance with aspects of the present disclosure.

Turning to FIG. 3, an example of a method 300 for determining the presence of an unauthorized RF device may be performed by one or more of the communication component 142, the identification component 144, the determination component 146, the alarm component 148, the processor 210, the memory 212, the RFID driver 220, and/or the scanner coil 222 of the RFID scanner 112.

At block 302, the method 300 may identify one or more authorized signal characteristic associated with one or more authorized RF signal. For example, the processor 210, the memory 212, and/or the identification component 144 may identify one or more authorized signal characteristic associated with the one or more authorized RF signal 130 as described above. The processor 210, the memory 212, and/or the identification component 144 may be configured to and/or define means for identifying one or more authorized signal characteristic associated with one or more authorized RF signal.

At block 304, the method 300 may receive at least one incoming RF signal having one or more incoming signal characteristic. For example, the processor 210, the memory 212, the communication component 142, the RFID driver 220, and/or the scanner coil 222 may receive the at least one incoming RF signal 136 having one or more incoming signal characteristic as described above. The processor 210, the memory 212, the communication component 142, the RFID driver 220, and/or the scanner coil 222 may be configured to and/or define means for receiving at least one incoming RF signal having one or more incoming signal characteristic.

At block 306, the method 300 may identify the one or more incoming signal characteristic. For example, the processor 210, the memory 212, and/or the identification component 144 may identify the one or more incoming signal characteristic as described above. The processor 210, the memory 212, and/or the identification component 144 may be configured to and/or define means for identifying the one or more incoming signal characteristic.

At block 308, the method 300 may determine a presence of the unauthorized RF device based on at least one of the one or more authorized signal characteristic or the one or more incoming signal characteristic. For example, the processor 210, the memory 212, and/or the determination component 146 may determine a presence of the unauthorized RF device 120 based on at least one of the one or more authorized signal characteristic or the one or more incoming signal characteristic as described above. The processor 210, the memory 212, and/or the determination component 146 may be configured to and/or define means for determining a presence of the unauthorized RF device based on at least one of the one or more authorized signal characteristic or the one or more incoming signal characteristic.

At block 310, the method 300 may activate an alarm in response to determining the presence of the unauthorized RF device. For example, the processor 210, the memory 212, and/or the alarm component 148 may activate the alarm 124 in response to determining the presence of the unauthorized RF device 120. The processor 210, the memory 212, and/or the alarm component 148 may be configured to and/or define means for transmitting a wireless signal to the wireless device to enable the RFID device to receive a RFID signal used to unlock the security tag from the merchandise.

Figure 4:
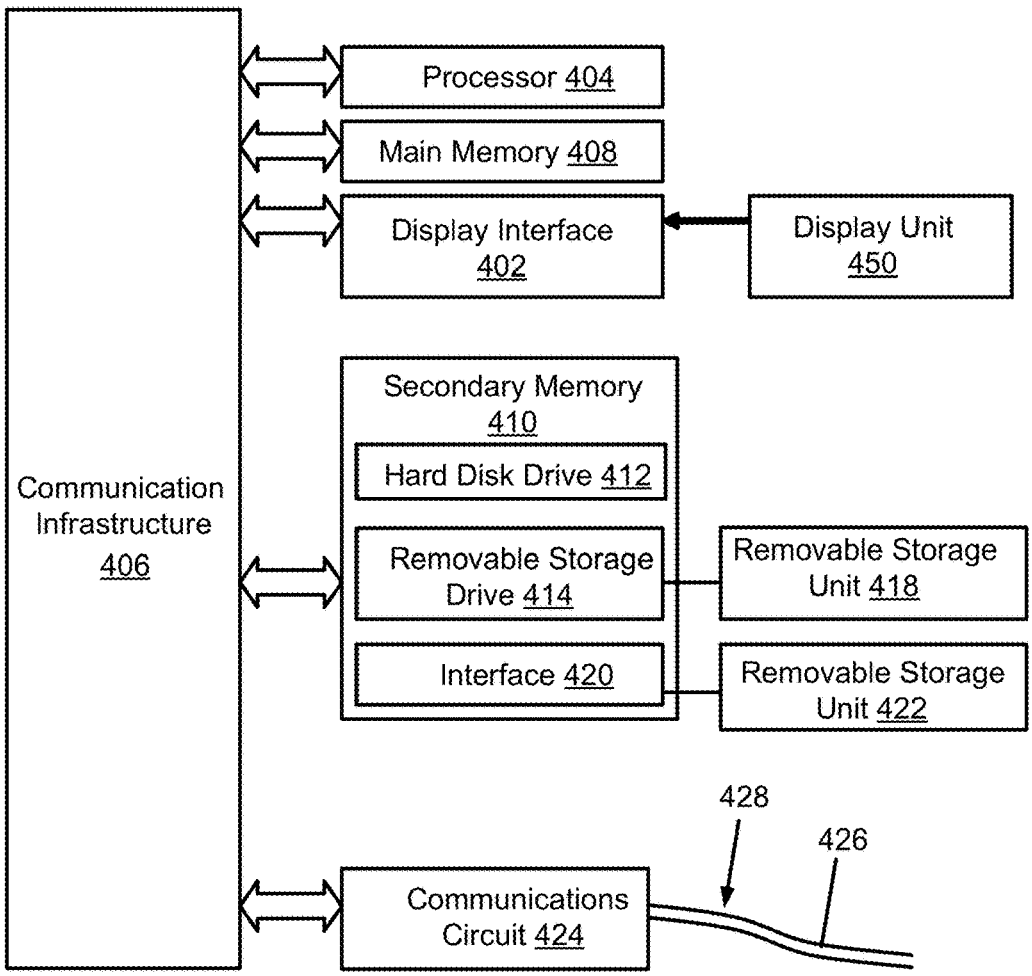
FIG. 4 illustrates an example of a computer system in accordance with aspects of the present disclosure.

Aspects of the present disclosures may be implemented using hardware, software, or a combination thereof and may be implemented in one or more computer systems or other processing systems. In an aspect of the present disclosures, features are directed toward one or more computer systems capable of carrying out the functionality described herein. An example of such the computer system 400 is shown in FIG. 4. In some examples, the RFID scanner 112 may be implemented as the computer system 400 shown in FIG. 4. The RFID scanner 112 may include some or all of the components of the computer system 400.

The computer system 400 includes one or more processors, such as processor 404. The processor 404 is connected with a communication infrastructure 406 (e.g., a communications bus, cross-over bar, or network). Various software aspects are described in terms of this example computer system. After reading this description, it will become apparent to a person skilled in the relevant art(s) how to implement aspects of the disclosures using other computer systems and/or architectures.

The computer system 400 may include a display interface 402 that forwards graphics, text, and other data from the communication infrastructure 406 (or from a frame buffer not shown) for display on a display unit 450. Computer system 400 also includes a main memory 408, preferably random access memory (RAM), and may also include a secondary memory 410. The secondary memory 410 may include, for example, a hard disk drive 412, and/or a removable storage drive 414, representing a floppy disk drive, a magnetic tape drive, an optical disk drive, a universal serial bus (USB) flash drive, etc. The removable storage drive 414 reads from and/or writes to a removable storage unit 418 in a well-known manner. Removable storage unit 418 represents a floppy disk, magnetic tape, optical disk, USB flash drive etc., which is read by and written to removable storage drive 414. As will be appreciated, the removable storage unit 418 includes a computer usable storage medium having stored therein computer software and/or data. In some examples, one or more of the main memory 408, the secondary memory 410, the removable storage unit 418, and/or the removable storage unit 422 may be a non-transitory memory.

Alternative aspects of the present disclosures may include secondary memory 410 and may include other similar devices for allowing computer programs or other instructions to be loaded into computer system 400. Such devices may include, for example, a removable storage unit 422 and an interface 420. Examples of such may include a program cartridge and cartridge interface (such as that found in video game devices), a removable memory chip (such as an erasable programmable read only memory (EPROM), or programmable read only memory (PROM)) and associated socket, and the removable storage unit 422 and the interface 420, which allow software and data to be transferred from the removable storage unit 422 to computer system 400.

Computer system 400 may also include a communications circuit 424. The communications circuit 424 may allow software and data to be transferred between computer system 400 and external devices. Examples of the communications circuit 424 may include a modem, a network interface (such as an Ethernet card), a communications port, a Personal Computer Memory Card International Association (PCMCIA) slot and card, etc. Software and data transferred via the communications circuit 424 are in the form of signals 428, which may be electronic, electromagnetic, optical or other signals capable of being received by the communications circuit 424. These signals 428 are provided to the communications circuit 424 via a communications path (e.g., channel) 426. This path 426 carries signals 428 and may be implemented using wire or cable, fiber optics, a telephone line, a cellular link, an RF link and/or other communications channels. In this document, the terms "computer program medium" and "computer usable medium" are used to refer generally to media such as the removable storage unit 418, a hard disk installed in hard disk drive 412, and signals 428. These computer program products provide software to the computer system 400. Aspects of the present disclosures are directed to such computer program products.

Computer programs (also referred to as computer control logic) are stored in main memory 408 and/or secondary memory 410. Computer programs may also be received via communications circuit 424. Such computer programs, when executed, enable the computer system 400 to perform the features in accordance with aspects of the present disclosures, as discussed herein. In particular, the computer programs, when executed, enable the processor 404 to perform the features in accordance with aspects of the present disclosures. Accordingly, such computer programs represent controllers of the computer system 400.

In an aspect of the present disclosures where the method is implemented using software, the software may be stored in a computer program product and loaded into computer system 400 using removable storage drive 414, hard disk drive 412, or the interface 420. The control logic (software), when executed by the processor 404, causes the processor 404 to perform the functions described herein. In another aspect of the present disclosures, the system is implemented primarily in hardware using, for example, hardware components, such as application specific integrated circuits (ASICs). Implementation of the hardware state machine so as to perform the functions described herein will be apparent to persons skilled in the relevant art(s).

It will be appreciated that various implementations of the above-disclosed and other features and functions, or alternatives or varieties thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A method of detecting an unauthorized radio frequency (RF) device by a RF scanner, comprising:

identifying, at the RF scanner, one or more authorized signal characteristic associated with at least one authorized RF signal;

transmitting, by the RF scanner, at least one source RF signal to read a security tag configured to backscatter the at least one authorized RF signal;

receiving, at the RF scanner, in response to transmitting the at least one source RF signal, at least one incoming RF signal having one or more incoming signal characteristic, wherein the at least one incoming RF signal is different than the at least one authorized RF signal;

identifying, at the RF scanner, the one or more incoming signal characteristic;

determining, at the RF scanner, a presence of the unauthorized RF device based on at least one of the one or more authorized signal characteristic or the one or more incoming signal characteristic; and transmitting an alarm message to an alarm to active the alarm in response to determining the presence of the unauthorized RF device.

2. The method of claim 1, wherein:

identifying the at least one authorized RF signal comprises identifying a first power level of the at least one authorized RF signal;

identifying the one or more incoming signal characteristic comprises identifying a second power level of the at least one incoming RF signal; and determining the presence of the unauthorized RF device comprises determining the first power level being lower than the second power level.

3. The method of claim 2, wherein the first power level is lower than a regulatory power level threshold and the second power level is higher than the regulatory power level threshold.

4. The method of claim 3, wherein determining the presence of the unauthorized RF device further comprises determining the first power level being lower than the second power level over a threshold duration.

5. The method of claim 1, further comprising, prior to receiving the at least one incoming RF signal:

receiving, at the RF scanner, a plurality of background signals;

wherein:

identifying the one or more authorized signal characteristic comprises determining a background power level threshold based on the plurality of background signals; and determining the presence of the unauthorized RF device comprises determining an incoming RF signal power level associated with the at least one incoming RF signal being higher than the background power threshold level.

6. The method of claim 1, wherein:

identifying the one or more authorized signal characteristic comprises identifying a first time associated with an active transmission of the at least one authorized RF signal and a second time associated with a suspension of the at least one authorized RF signal, wherein the first time is different than the second time;

receiving the at least one incoming RF signal comprises receiving the at least one incoming RF signal during at least a portion of the second time; and determining the presence of the unauthorized RF device comprises determining the presence of the unauthorized RF device in response to receiving the at least one incoming RF signal during the at least a portion of the second time.

7. The method of claim 1, further comprising:

receiving, at the RF scanner, a response RF signal in response to transmitting the at least one authorized RF signal;

wherein:

identifying one or more authorized signal characteristic comprises identifying a response RF signal power level of the response RF signal; and determining the presence of the unauthorized RF device comprises determining the response RF signal power level being lower than an incoming RF signal power level of the incoming RF signal.

8. The method of claim 1, wherein:

identifying the one or more authorized signal characteristic comprises identifying a first frequency of the at least one authorized RF signal;

identifying the one or more incoming signal characteristic comprises identifying a second frequency of the at least one incoming RF signal; and determining the presence of the unauthorized RF device comprises determining the first frequency being different than the second frequency.

9. The method of claim 1, further comprising:

transmitting, from the RF scanner, a plurality of authorized RF signals to a plurality of control radio frequency identification (RFID) devices, wherein each of the plurality of control RFID devices is configured to transmit a response RF signal of a plurality of response RF signals in response to receiving one of the plurality of authorized RF signals; and wherein determining the presence of the unauthorized RF device comprises failing to receive at least one of a plurality of response RF signals.

10. A radio frequency identification (RFID) scanner, comprising:

a RFID driver;

a memory that stores instructions; and a processor configured to execute the instructions to:

identify, at the RFID scanner, one or more authorized signal characteristic associated with at least one authorized RF signal;

cause the RFID driver to transmit at least one source RF signal to read a security tag configured to backscatter the at least one authorized RF signal;

cause the RFID driver to receive, in response to transmitting the at least one source RF signal, at least one incoming RF signal having one or more incoming signal characteristic;

identify, at the RFID scanner, the one or more incoming signal characteristic;

determine, at the RFID scanner, a presence of the unauthorized RF device based on at least one of the one or more authorized signal characteristic or the one or more incoming signal characteristic; and transmit an alarm message to an alarm to active the alarm in response to determining the presence of the unauthorized RF device.

11. The RFID scanner of claim 10, wherein:

identifying the at least one authorized RF signal comprises identifying a first power level of the at least one authorized RF signal;

identifying the one or more incoming signal characteristic comprises identifying a second power level of the at least one incoming RF signal; and determining the presence of the unauthorized RF device comprises determining the first power level being lower than the second power level.

12. The RFID scanner of claim 11, wherein the first power level is lower than a regulatory power level threshold and the second power level is higher than the regulatory power level threshold.

13. The RFID scanner of claim 12, wherein determining the presence of the unauthorized RF device further comprises determining the first power level being lower than the second power level over a threshold duration.

14. The RFID scanner of claim 10, wherein the processor is further configured to execute the instructions to, prior to receiving the at least one incoming RF signal:

receive, at the RFID scanner, a plurality of background signals;

wherein:

identifying the one or more authorized signal characteristic comprises determining a background power level threshold based on the plurality of background signals; and determining the presence of the unauthorized RF device comprises determining an incoming RF signal power level associated with the at least one incoming RF signal being higher than the background power threshold level.

15. The RFID scanner of claim 10, wherein:

identifying the one or more authorized signal characteristic comprises identifying a first time associated with an active transmission of the at least one authorized RF signal and a second time associated with a suspension of the at least one authorized RF signal, wherein the first time is different than the second time;

receiving the at least one incoming RF signal comprises receiving the at least one incoming RF signal during at least a portion of the second time; and determining the presence of the unauthorized RF device comprises determining the presence of the unauthorized RF device in response to receiving the at least one incoming RF signal during the at least a portion of the second time.

16. The RFID scanner of claim 10, wherein the processor is further configured to execute the instructions to:

receive, at the RFID scanner, a response RF signal in response to transmitting the at least one authorized RF signal;

wherein:

identifying one or more authorized signal characteristic comprises identifying a response RF signal power level of the response RF signal; and determining the presence of the unauthorized RF device comprises determining the response RF signal power level being lower than an incoming RF signal power level of the incoming RF signal.

17. The RFID scanner of claim 10, wherein:

identifying the one or more authorized signal characteristic comprises identifying a first frequency of the at least one authorized RF signal;

identifying the one or more incoming signal characteristic comprises identifying a second frequency of the at least one incoming RF signal; and determining the presence of the unauthorized RF device comprises determining the first frequency being different than the second frequency.

18. The RFID scanner of claim 10, wherein the processor is further configured to execute the instructions to:

transmit, from the RFID scanner, a plurality of authorized RF signals to a plurality of control radio frequency identification (RFID) devices, wherein each of the plurality of control RFID devices is configured to transmit a response RF signal of a plurality of response RF signals in response to receiving one of the plurality of authorized RF signals; and wherein determining the presence of the unauthorized RF device comprises failing to receive at least one of a plurality of response RF signals.

19. A radio frequency identification (RFID) system, comprising:

a security tag configured to backscatter at least one authorized RF signal; and a RFID scanner comprising:

a RFID driver;

a memory that stores instructions; and a processor configured to execute the instructions to:

identify, at the RFID scanner, one or more authorized signal characteristic associated with the at least one authorized RF signal;

cause the RFID driver to transmit at least one source RF signal to read the security tag;

cause the RFID driver to receive, in response to transmitting the at least one source RF signal, at least one incoming RF signal having one or more incoming signal characteristic;

identify, at the RFID scanner, the one or more incoming signal characteristic;

determine, at the RFID scanner, a presence of the unauthorized RF device based on at least one of the one or more authorized signal characteristic or the one or more incoming signal characteristic; and transmit an alarm message to an alarm to active the alarm in response to determining the presence of the unauthorized RF device.

20. The RFID system of claim 19, wherein:

identifying the at least one authorized RF signal comprises identifying a first power level of the at least one authorized RF signal;

identifying the one or more incoming signal characteristic comprises identifying a second power level of the at least one incoming RF signal; and determining the presence of the unauthorized RF device comprises determining the first power level being lower than the second power level.

21. The RFID system of claim 20, wherein the first power level is lower than a regulatory power level threshold and the second power level is higher than the regulatory power level threshold.

22. The RFID system of claim 21, wherein determining the presence of the unauthorized RF device further comprises determining the first power level being lower than the second power level over a threshold duration.

23. The RFID system of claim 19, wherein the processor is further configured to execute the instructions to, prior to receiving the at least one incoming RF signal:

receive, at the RFID scanner, a plurality of background signals;

wherein:

identifying the one or more authorized signal characteristic comprises determining a background power level threshold based on the plurality of background signals; and determining the presence of the unauthorized RF device comprises determining an incoming RF signal power level associated with the at least one incoming RF signal being higher than the background power threshold level.

24. The RFID system of claim 19, wherein:

identifying the one or more authorized signal characteristic comprises identifying a first time associated with an active transmission of the at least one authorized RF signal and a second time associated with a suspension of the at least one authorized RF signal, wherein the first time is different than the second time;

receiving the at least one incoming RF signal comprises receiving the at least one incoming RF signal during at least a portion of the second time; and determining the presence of the unauthorized RF device comprises determining the presence of the unauthorized RF device in response to receiving the at least one incoming RF signal during the at least a portion of the second time.

25. The RFID system of claim 19, wherein the processor is further configured to execute the instructions to:

receive, at the RFID scanner, a response RF signal in response to transmitting the at least one authorized RF signal;

wherein:

identifying one or more authorized signal characteristic comprises identifying a response RF signal power level of the response RF signal; and determining the presence of the unauthorized RF device comprises determining the response RF signal power level being lower than an incoming RF signal power level of the incoming RF signal.

26. The RFID system of claim 19, wherein:

identifying the one or more authorized signal characteristic comprises identifying a first frequency of the at least one authorized RF signal;

identifying the one or more incoming signal characteristic comprises identifying a second frequency of the at least one incoming RF signal; and determining the presence of the unauthorized RF device comprises determining the first frequency being different than the second frequency.

27. The RFID system of claim 19, wherein the processor is further configured to execute the instructions to:

transmit, from the RFID scanner, a plurality of authorized RF signals to a plurality of control radio frequency identification (RFID) devices, wherein each of the plurality of control RFID devices is configured to transmit a response RF signal of a plurality of response RF signals in response to receiving one of the plurality of authorized RF signals; and wherein determining the presence of the unauthorized RF device comprises failing to receive at least one of a plurality of response RF signals.

* * * * *